US006883940B2

(12) United States Patent
Grajetzky et al.

(10) Patent No.: US 6,883,940 B2
(45) Date of Patent: Apr. 26, 2005

(54) RECESSED LUMINAIRE HAVING A DOME-SHAPED REFLECTOR

(75) Inventors: Hans-Joachim Grajetzky, Lemgo (DE); Karl-Heinz Holzkämper, Lemgo (DE)

(73) Assignee: Zumtobel Staff GmbH & Co. KG, Lemgo (DE)

( * ) Notice: Subject to any disclaimer, the term of this patent is extended or adjusted under 35 U.S.C. 154(b) by 90 days.

(21) Appl. No.: 10/244,468

(22) Filed: Sep. 17, 2002

(65) Prior Publication Data

US 2003/0063467 A1 Apr. 3, 2003

Related U.S. Application Data

(63) Continuation of application No. PCT/EP01/02336, filed on Mar. 1, 2001.

(30) Foreign Application Priority Data

Mar. 17, 2000 (DE) ..... 100 13 086

(51) Int. Cl.[7] ..... F21V 17/00

(52) U.S. Cl. ..... 362/364; 362/148; 362/226; 362/365

(58) Field of Search ..... 362/226, 365, 362/364, 148

(56) References Cited

U.S. PATENT DOCUMENTS 4,384,318 A 5/1983 Reibling ..... 362/216
5,924,790 A * 7/1999 Ponton et al. ..... 362/370
5,931,567 A 8/1999 Salzmann et al. ..... 362/304
6,132,069 A * 10/2000 Sato et al. ..... 362/365
6,155,693 A 12/2000 Spiegel et al. ..... 362/147
6,343,873 B1 * 2/2002 Eberhard et al. ..... 362/364
6,461,016 B1 * 10/2002 Jamison et al. ..... 362/147
6,582,106 B1 * 6/2003 Jamison ..... 362/396

FOREIGN PATENT DOCUMENTS

| | | |
|---|---|---|
| DE | 4344376 A1 | 6/1995 |
| EP | 0551610 A1 | 7/1993 |
| EP | 0791781 A1 | 8/1997 |
| FR | 2238117 A | 2/1975 |

* cited by examiner

*Primary Examiner*—Sandra O'Shea
*Assistant Examiner*—Jacob Y. Choi
(74) *Attorney, Agent, or Firm*—Fitzpatrick, Cella, Harper & Scinto

(57) ABSTRACT

A recessable luminaire (1), having a dome-shaped reflector and a light source located at least partially outside the reflector (6) such that a light source (8) carried by the carrier is located within the reflector (6). A mounting ring (9) is arranged to engage the reflector (6) around and near its edge region. The mounting ring 9 has connection means for attaching the light source carrier (7). The connection means is formed by a plug-in pin (27*b*) on the mounting ring (9) or on the light source carrier (7) and at least one corresponding plug-in fitting (27*a*) on the light source carrier (7) or on the mounting ring (9).

9 Claims, 3 Drawing Sheets

1
3
4
5
6
7
7a
7b
7c
8
9
9a
9b
11
11a
11b
12
13
14
15
16
17
18
19
21
22
23
23a
23b
24
25
26
27
27a
27b
27c
28
29
31
32
35
36
43
W
X
Y 6
17
23a
23c
24
26
W 3
6
9
9a
9b
17
24
41
41a
42
43
45
45a
45b
49

RECESSED LUMINAIRE HAVING A DOME-SHAPED REFLECTOR

CROSS REFERENCE TO RELATED APPLICATIONS

This is a Continuation of International Application PCT/EP01/02336 filed Mar. 1, 2001 which in turn claims priority of German application DE 100 13 086.0, filed Mar. 17, 2000, the priorities of which are hereby claimed, said International Application having been published in German, but not in English, as WO 01/69980 A1 on Sep. 20, 2001.

BACKGROUND OF THE INVENTION

1. Field of the Invention

The invention relates luminaires and, in particular, it concerns a recessable luminaire which can be easily mounted and demounted.

2. Description of the Related Art

A recessed luminaire of this kind is described in DE 43 44 376 A1. With this previously known recessed luminaire there is provided a base housing which by means of spring tabs arranged on its periphery and engaging behind an installation opening edge can be fixed on the installation opening edge. The base frame has at its end in the light emission direction of the luminaire an outwardly projecting flange part for covering over a joint present between the base housing and the installation opening edge in the installed condition. A fitting carrier for a lamp of the luminaire is arranged outside the reflector in a position in which it so lies outwardly opposite to the lead-through hole in the reflector side wall that the lamp can be mounted on the fitting carrier from the inner space of the reflector through the lead-through hole. Thereby, the fitting carrier is releasably connected with the base housing surrounding the reflector, and thereby held. The base housing consists of a tube and a flange which projects radially from an edge of the tube. The edge of the tube section lying axially opposite the flange is located at approximately middle height, in comparison with the height of the base frame, there extending arc-like from this inner edge three struts, distributed around the periphery, which are connected with one another in the ridge of the base frame and which form the fixing point for the reflector. The fitting carrier is releasably connected on the one hand by means of latch fastenings in the ridge region of the struts, the latch fastenings cooperating with associated centering ribs arranged on the inner edge of the tube section.

With this known configuration a large production outlay is inevitable, which also leads to mounting and de-mounting which is complex in terms of manipulation and is time consuming. Further, this known configuration leads to a structure of the recessed luminaire which is large, which requires a large receiving space for the recessed luminaire.

SUMMARY OF THE INVENTION

An object of the invention is to simplify a recessable luminaire of the kind indicated above. The outlay in terms of material and production effort is to be reduced, and there is also to be attained a compact structure with a stable mounting of the light source carrier being ensured.

According to the invention, there is provided a luminaire having a mounting ring and a connection means for a light source carrier. The connection means has at least one plug-in pin on the mounting ring, or on the light source carrier, and at least one corresponding plug-in fitting on the light source carrier or on the mounting ring. The plug-in pin extends approximately parallel to a middle axis of the mounting ring. Through this, the light source carrier is arranged exclusively on the mounting ring, there being provided a plug-in fitting which ensures a stable mounting, in particular a mounting which secures against a pivotal movement, of the light source carrier. A plug-in fitting can be realized in a compact construction with slight outlay in terms of material, whilst ensuring a great stability. The configuration in accordance with the invention thus makes possible a simple, small and stable and compact manner of construction which can be produced and mounted or de-mounted in simple manner. Thus, the production costs for the recessed luminaire can be substantially reduced. A further advantage consists in that the plug-in fitting makes possible a mounting or de-mounting of the light source carrier in a mounting or de-mounting movement direction extending approximately parallel to the middle axis of the mounting ring, which can be carried out in a readily manipulable manner.

Additional advantageous constructions which may be employed for carrying out the invention are disclosed and claimed herein.

The plug-in pin and/or the plug-in fitting, for example formed by means of a plug-in sleeve, preferably have a non-round cross-sectional shape. Through this there can be formed in the plug-in fitting, in simple manner, a rotational lock.

It is further of advantage to associate with the plug-in fitting, in the inserted disposition, a positioning device effective along the mounting or de-mounting movement direction, which makes it possible in the plugged together disposition to secure the plug-in pin and the plug-in fitting to one another. This is advantageous for two reasons. On the one hand, there exists, without a securing means, the risk upon mounting a lamp on the light source carrier, in this case formed as a fitting carrier, that as a result of the mounting or de-mounting, the light source carrier could be unintentionally released from the plug-in fitting. Such a positioning device can be formed by means of a clamping device, the clamping effect of which can be manually overcome. A further advantage of the configuration in accordance with the invention consists in that it is suited in a simple manner for reflectors of different structural heights. For this use, there is proposed an adaptor constituted as an extension piece, which makes it possible to employ the plug-in connection part arranged on the mounting ring for reflectors of different heights, without modification.

Further features in accordance with the invention lead to further simplifications of the recessed luminaire, which can be economically produced, facilitate mounting and de-mounting, lead to small or low-profile manners of construction, and improve the appearance of the recessed luminaire.

BRIEF DESCRIPTION OF THE DRAWINGS

Below there will be described in detail an embodiment of the invention and further advantages which can be achieved thereby with reference to the drawings.

DETAILED DESCRIPTION OF THE PREFERRED EMBODIMENT

Figure 1:
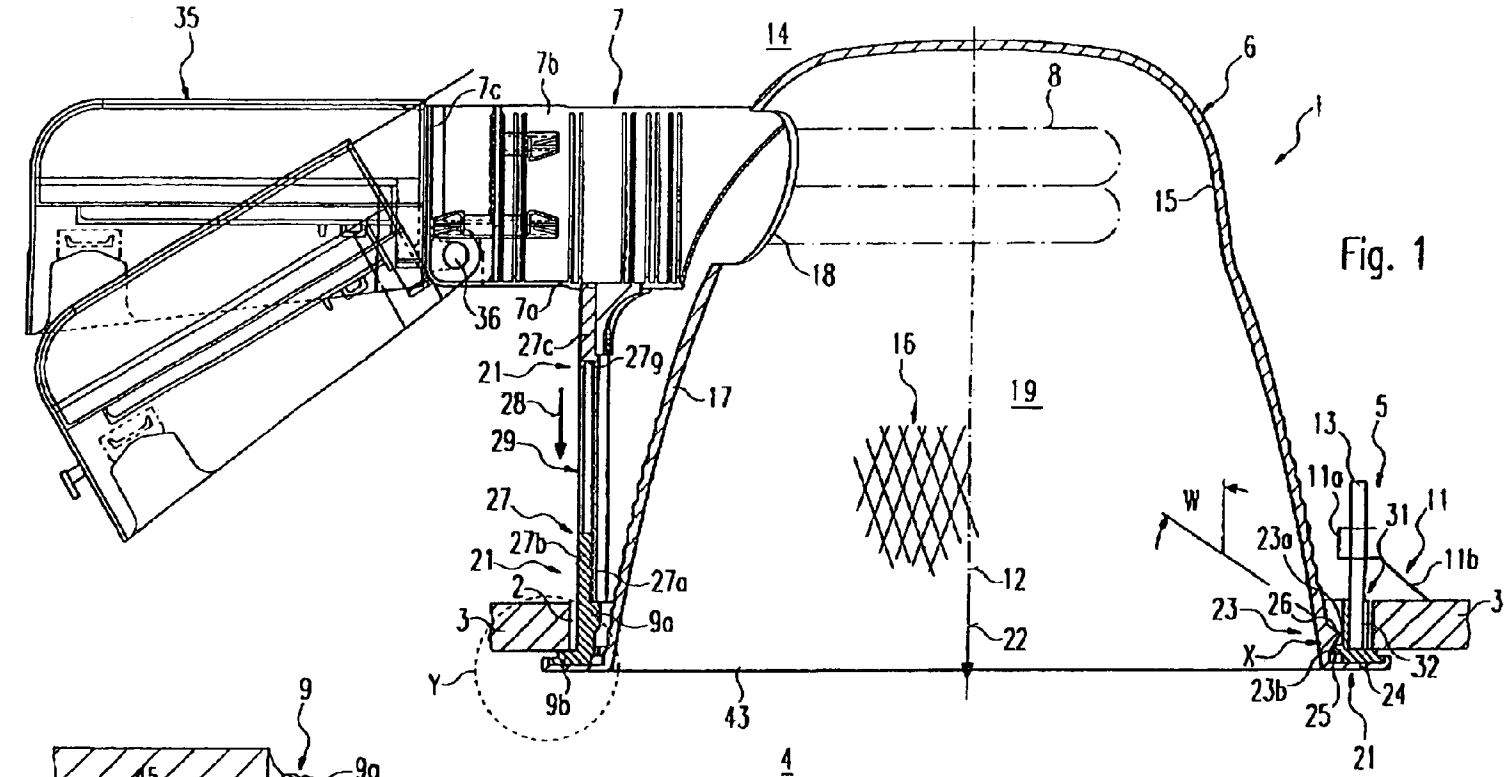
FIG. 1 is a partial cross-section view, taken in elevation, of a recessed luminaire in accordance with the invention.

As seen in FIG. 1, the recessed luminaire, designated in its entirety by 1, can be installed in an installation opening 2 of an installation wall 3 which may be a ceiling or a wall of a room 4 to be illuminated with the recessed luminaire 1. For fastening the recessed luminaire 1 to the installation wall 3 there are provided first holder means 5 which will be described further below.

The main parts of the recessed luminaire 1 are a dome-shaped reflector 6, a light source carrier 7 for receiving at least one light source 8 and a mounting ring 9 (FIG. 3), which with a tube support 9*a* and a flange part 9*b* outwardly projecting from this tube support, is formed with an angle shape and with the aid of the first holder means 5 (FIG. 1) can be fixed in the installation opening, for example on the installation opening edge. For this purpose there may serve a plurality of holder arms 11 arranged distributed around the circumference and formed for example by means of leaf springs, of which only one is schematically illustrated in FIG. 1. The holder arms 11 are, with a base section 11*a*, each displaceably mounted on a carrier bar 13 extending approximately parallel to a middle axis 12 of the recessed luminaire 11, whereby in each case the base section 11*a* is self-actingly arrested on the carrier bar 13, in particular by means of a clamping effect, when a holder finger 11*b*, outwardly projecting and engaging below the installation opening edge, bears with a pressure force on the side of the installation wall 3 away from the room 4. By these means, the mounting ring 9 is fixed in the installation opening 2, whereby its tube support 9*a* projects into the installation opening 2 and its flange part 9*b* bears on the installation wall 3. Axially, the tube section 9*a* is relatively short. It does not need to project far into the free space 14 behind the installation wall 3. It is sufficient when the axial length of the tube support 9*a* corresponds approximately to the thickness of the installation wall 3, whereby the axial length may be dimensioned to be somewhat greater or also somewhat smaller. The width of the flange part 9*b* is so dimensioned that the flange part 9*b* engages below the installation opening edge and therewith covers over the installation gap between the tube support 9*a* and the installation opening edge.

Figure 3:
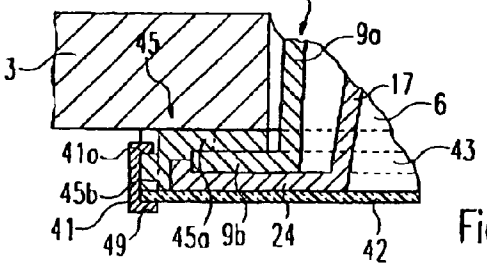
FIG. 3 is an enlarged fragmentary view of a region designated by Y in FIG. 1 and showing additionally mounted accessory parts.

Preferably, the reflector 6 has the form of a dome closed in the ridge region, the inner surface 15 of which is constituted as a reflection surface and which may be formed for example at least in the free edge region with facet surfaces 16, of which a part region is illustrated by hatching by way of example in lozenge-like shape. In the upper region of its side wall 17, the reflector 6 has a lead-through hole 18 in the region of which the light source carrier 7 is held, for example in a position outwardly opposite the lead-through hole 18, as FIG. 1 shows. With the present exemplary embodiment, the light source carrier 7 is a fitting carrier having one or more non-illustrated fittings which, with one or more lamps, are accessible from an inner space 19 of the reflector 6, so that at least one lamp is mountable from the inside onto the light source carrier in a position in which its light source 8 is located in the inner space 19. The reflector 6 is releasably connected or connectable with the mounting ring 9 by means of a plug-in fitting designated in its entirety by 21. The plug-in fitting 21 makes it possible to insert the reflector into the mounting ring 9 in the direction opposite to the light emission direction 22, and thereby to connect it with the mounting ring 9. There may be provided, as shown in FIG. 1, a plurality, for example three, latching devices 23 distributed around the circumference for the releasable latching of the reflector 6 with the mounting ring 9. The latching devices 23 have in each case a latch nose 23*a* which in the latched position engages behind a latch edge 23*b*. This engagement behind is, due to the elasticity present of at least one of the parts standing in latching engagement, releasable in that the latching can be overcome manually or by means of a tool, here by means of a movement of the reflector 6 in the light emission direction 22. with the present configuration, the latch nose 23*a* is arranged on the outer side of the side wall 17, preferably being formed thereon in one piece. The axial spacing of the latching elements from the free edge of the reflector 6 or of the mounting ring 9 is selected to be of such a size that in the latching position an edge flange 24 projecting outwardly from the side wall 14 bears on the flange part 9*b* and preferably covers this over or projects over this, whereby it may also engage behind the flange part 9*b* in an angled manner, as FIGS. 1 and 3 show. The latching edge 23*b* may be formed by means of an inner web 25 on the inner surface of the mounting ring 9.

Figure 2:
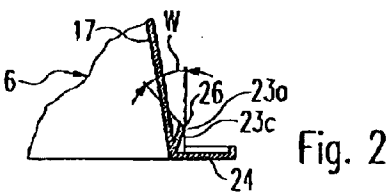
FIG. 2 is an enlarged fragmentary view of a region designated by X in FIG. 1.

FIG. 2 shows the latching nose 23*a* in a modified configuration. Here, the latching nose 23*a* is yieldingly mounted, so that it can spring in against an elastic return force. Here, the latching nose 23*a* may be arranged on a spring arm 23*c*, which may extend along or obliquely of the middle axis 12 and which may preferably be formed in one piece on the mounting ring 9 or on its side wall 14. With the present exemplary embodiment the spring arm 23*c* is formed on in the corner region of the mounting ring 9 whereby it extends, if applicable obliquely, in the direction opposite to light emission direction 22. The spring arm 23*c* can, due to its material elasticity, be transversely elastically bent in. In order to simplify or make possible the latching, with the present exemplary embodiments, the latching nose 23*a* and/or the latching edge 23*b* or the inner web 25, has associated therewith an oblique or rounded lead-in surface 26, which manifests an acute angle W with reference to the middle axis 12, which angle is open in the direction opposite to the emission direction 22.

The light source carrier 7 is connected exclusively with the mounting ring 9, by means of a special connection means, here connected exclusively with the tube support 9*a* of the mounting ring. The connection means are formed by means of a plug-in connection having a plug-in fitting 27*a* on the one plug-in connection part and a plug-in pin 27*b*, which can be inserted in the plug-in fitting 27*a*, on the other connection part. The plug-in direction 28 of the plug-in connection 27 extends approximately parallel to the middle axis 12 and in the emission direction 22. The cross-sectional form of the plug-in fitting 27*a* and of the plug-in pin 27*b* is preferably non-round. By these means there is formed a rotation lock which positions the light source carrier 7 in its transverse disposition. The plug-in connection 27 distinguishes itself through a great stability, with simple and small construction, whereby it can in particular be constituted to be relatively thin, and thus mounted on the tube support 9*a*, in particular formed in one piece thereon, which should be formed as thin as possible in order to have a greater cross-sectional surface available for the reflector. This can be realized in that the plug-in pin has the cross-sectional form of a broad and relatively thin web. This applies also for the attachment of the carrier bars 13 which preferably are likewise connected with the tube support 9*a* by means of plug-in fittings 31. Preferably there are provided, prefabricated, in the tube support 9*a* in each case an undercut groove or plug-in recesses 32 forming a plug-in fitting 31 into which the carrier bars 13 are placed and attached, for example by means of gluing or press fitting. There can be seen from FIG. 4 the elongate, in the circumferential direction, cross-sectional form of the for example three plug-in recesses 32 for the carrier bars 13. The plug-in recesses 32 may, for the purpose of material savings and small width, be undercut on one side and thus open to the side; here they are inwardly open.

Figures 4, 5:
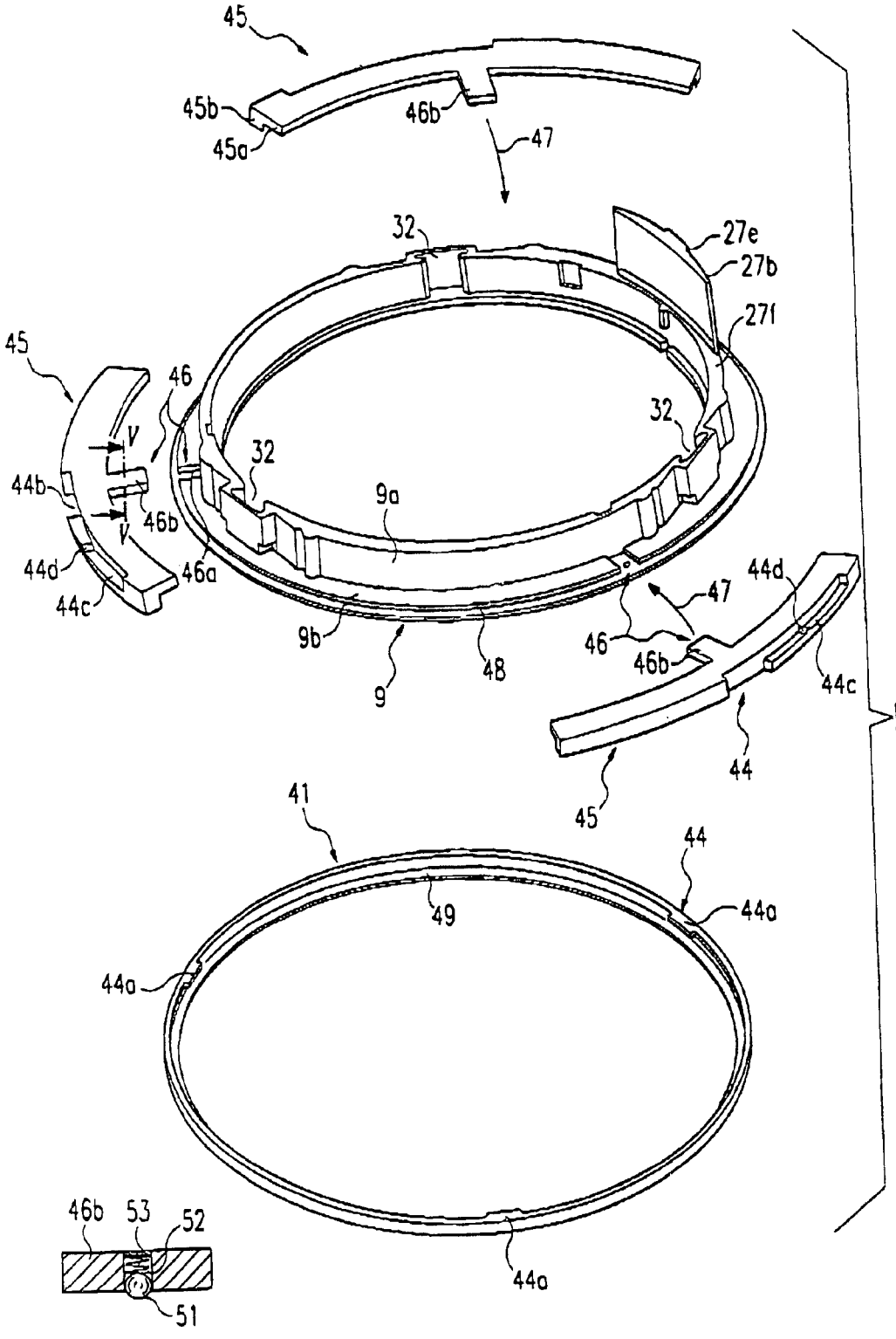
FIG. 4 is an exploded perspective view showing a mounting ring with accessory parts used in the luminaire of FIG. 1.
FIG. 5 is a partial section taken along line V—V in FIG. 4.
Figure 6:
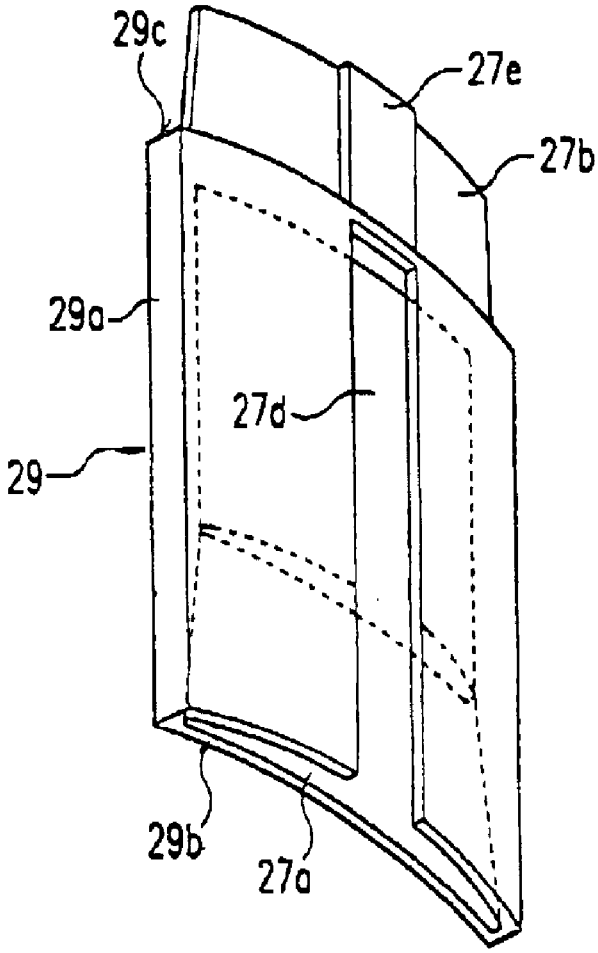
FIG. 6 is a perspective view of an adaptor formed as an extension piece used in the luminaire of FIG. 1.

With the present exemplary embodiment according to FIGS. 1 and 5, the plug-in connection has, between two matching plug-in connection parts, a plug-in adaptor 29 which on its one end has a plug-in recess or plug-in fitting 27*a* matching the plug-in connection 27 present, and at its other end has a matching plug-in pin 27*b*, and which forms an extension piece. Through this it is possible to realize the plug-in connection 27 selectively with or without a plug-in adapter 29. Without plug-in adaptor 29, the plug-in connection 27 is suitable for a reflector 6 of lesser structural height, which otherwise is formed in the region of its free edge as described above. Through this it is possible to combine one and the same mounting ring with reflectors 6 of differently sized structural height and thus to adapt the luminaire to different illumination requirements. In the configuration according to FIG. 1 there are thus present in fact two plug-in connections 21 in coaxial arrangement. It is advantageous to associate with the plug-in connection or connections 21 in each case a positioning device 33 which is effective in the plugged together position, which brings about a fixing of the plug-in connection parts in the plugged together condition. This-is advantageous for providing the plug-in connection 27 with a certain stability in the plugged together condition. Further, by means of a such a positioning device 33 it is prevented that the plug-in connection parts can be released from one another unintentionally, for example upon the mounting of a lamp. The positioning device 33 can be formed for example by means of a latching device or a clamping device. The positioning device 33 is preferably releasable by being overcome manually with a certain application of force. A clamping device can for example be realized in that the plug-in pin 27*b* is formed to be conically convergent towards its free end and the plug-in fitting 27*a* has a matching and corresponding form. Such a conical configuration also facilitates the plugging together, because in the entry region of the plug-in fitting a considerable play for movement is available. Further, the conical form can provide the positioning device 33 in that in the inserted condition the cone connection jams. The plug-in recess 27*a* can be slotted on a broad side by means of a longitudinal slot 27*d* in which a web 27*e* on the plug-in pin 27*b* can engage. The plug-in adaptor 29, which is an intermediate piece, may have a thickened shaft 29*a* through which there are provided on its plug-in recess 27*a* and its plug-in pin 27*b* end or step surfaces 29*b*, 29*c* which, with corresponding step surfaces 27*f*, 27*g* at the foot of the corresponding plug-in pin 27*b* and on the edge of the corresponding plug-in recess 27*a*, form stops.

Within the scope of the present invention both plug-in connection parts of the plug-in connection 27 may each project, from the parts carrying them, towards one another with a rod-like base section 27*c*. The plug-in connection parts standing up from the light source carrier 7 may be formed on, preferably in one piece, a floor wall 7*a* of a housing forming the light source carrier 7, which furthermore may have side walls 7*b* lying opposite to one another and at its side away from the reflector 6 an end wall 7*c* which if appropriate may be formed with cable lead-through holes.

The light source carrier 7 may, on its end side away from the reflector 6, be connected with a cable connector housing 35. With the present configuration, the connector housing 35 is a separate component which is pivotable between a transversely upstanding position, referred to the middle axis 12, into a position displaced towards the mounting ring 9. For fixing the connector housing 35 in the first-mentioned position there may be provided a positioning device, for example in the form of a latching device or a clamping device. With the present exemplary embodiment a joint 36, making the pivoting possible, is arranged in the edge region between the floor wall and the end wall.

The mounting ring 9 is suitable as a carrier for a holder ring 41 for holding at least one additional component 42 or accessory part, which may be for example a light permeable plate, which is releasably held by the holder ring 41 in a position covering the emission opening 43 of the reflector 6. For releasable connection directly or indirectly with the flange part 9*b* there is provided a so-called bayonet connection 44 having bayonet connection parts which correspond to one another.

With the present configuration there serve for the releasable attachment of the holder ring 41 at least two, for example three, plug-in elements 45 arranged distributed on the circumference, here for example in the form of ring segments which on the one hand, in each case by means of a plug-in connection 46 having a plug-in recess 46*a* on the one connection part and a plug-in pin 46*b* insertable therein on the other connection part, are connectable with the flange part 9*b* of the mounting frame 9. For connecting the plug-in elements 45 with the holder ring 41 there serve connection parts corresponding to one another, which are preferably formed by means of the bayonet connection 44.

The insertion direction 47 of the plug-in fittings 46 is directed transversely of the middle axis 12, radially inwardly, as is illustrated by the associated arrows shown in FIG. 4. The plug-in recesses 46*a* are thus, referred to the middle axis 12, radially outwardly opened. They may also be open towards the inner side of the flange part 9*b* which is intended for bearing on the installation wall 3, as FIGS. 3 and 4 clearly show. With the present exemplary embodiment, the plug-in recesses 46*a*, and the plug-in pins 46*b* have each a quadrilateral, in particular flat cross-sectional form. The plug-in elements 45 are formed in an angled manner with a radially inwardly directed plug-in element limb 45*a* and a plug-in element limb 45*b* extending in the emission direction 22. On the outer edge of the flange part 9*b* away from the emission direction 22 there is arranged a ring groove 48. The plug-element limb 45*a* is, with regard to its axial dimension, so adapted to the axial depth of the ring groove 48 that on the side towards the installation wall 3 it ends approximately flush with the remaining flange section of the flange part 9*b*.

The bayonet connections 44 are each formed by means of a bayonet nose 44*a* and a bayonet recess 44*b*, and a bayonet step 44*c* adjoining onto the bayonet recess in the circumferential direction. The bayonet recess 44*b*, arranged outwardly on the plug-in element 45, is open radially outwardly and in the emission direction 22. Thus, the bayonet noses 44*a* can be introduced into the bayonet recesses 44*b* by an axial movement of the holder ring 41 opposite to the emission direction 22, and then introduced into the bayonet steps 44*c* by turning. The bayonet noses 44*a* are located radially inwardly on the edge of the holder ring 41 away from the emission direction 22. Further, the holder ring 41 may be formed by means of a thin sleeve. On at least one surface of the bayonet steps 44*c* there may be formed, for example formed on, a cam 44*d* having rounded or oblique lead-in surfaces, which constitutes a securing means, which can be manually overcome, against a reverse turning of the holder ring 41.

For holding the projecting or additional component 42, the holder ring 41 may have on its edge facing in the emission direction 22 a plurality of holder parts arranged distributed around the circumference or an encircling holder web 49, which engage or engages behind the additional component 42. The introduction of the additional component 42, for example a plate, between the bayonet noses 44*a* and the holder web 49 can be ensured for example due to the material elasticity of the holder ring 41, which is preferably of plastics. The reflector 6, the mounting ring 9, the adaptor 29, the light source carrier 7 and the plug-in elements 45 may also be of plastics. For reasons of stability it is advantageous alternatively to form the mounting ring 9 and possibly also the plug-in elements 45 and the adaptor 29 of light metal, in particular aluminum. For this purpose there is preferably suited die casting technology or injection molding technology, which make possible a rapid and an economical manufacture even with difficult shapings.

For securing the plug-in pins 46*b* in the plug-in recesses 46*a* there may be provided a positioning device. This can be formed by means of an elastically yielding pressure element, which is arranged on the one plug-in connection part and preferably latches into a recess on the other plug-in connection part. The pressure element may be formed by means of a rounded pin or a ball 51 in a transverse bore 52 in the plug-in pin 46*b* and be prevented from falling out of the bore by means of a turned in bore edge. By means of a spring 53 arranged in the bore, which bears on the base of the bore or on a closure part, the desired pressure tension can be produced.

The installation of the recessed luminaire 1 can be effected in accordance with the following method steps.

Initially, the mounting ring 9 is placed into the installation opening 2 and fixed with the holder arms 11 engaging behind the installation opening edge. The carrier bars 13 and holder arms 11 are pre-installed on the mounting ring 9 in the factory. The installation into the installation opening 2 can be carried out readily through the ring opening. Then, the light source carrier 7 is brought into its mounting position through the mounting ring 9 and connected with the mounting ring 9 by plugging in. Thereby, the connector housing 35 may be in its pivoted out or pivoted in position. The latter position improves the accessability to the connector housing 35 which is open on its side towards the holder ring. With the next method step, the reflector 6 is inserted and latched into the mounting ring 9. Then, the light source 8 or the at least one lamp can be mounted on the light source carrier 7 from the inner space of the reflector 6, for example being plugged into the fitting carrier. The connection of the operating means for current supply, arranged for example in the light source carrier 7 or in the connector housing 35, may be effected before the mounting of the mounting ring 9 or before the mounting of the light source carrier 7. Insofar as the mounting of an accessory part 42 is desired, the plug-in elements 45 are then plugged in, radially inwardly, into the plug-in recesses 46*a*, and then the holder ring 41, for example with the additional part 42 located therein, can be mounted. The de-mounting can be carried out with method steps of reverse order.

What is claimed is:

1. A recessable luminaire comprising:

a dome-shaped reflector formed with a lead-through hole in a reflector side wall thereof;

a light source carrier carrying a light source, said light source carrier being located at least partially outside said reflector such that the lead-through hole is passed through by said light source carrier or the light source and such that at least the light source is located within the reflector; and a mounting ring arranged to engage said reflector around and near its edge region, said mounting ring having connection means for attaching said light source carrier thereto, said connection means being realized by means of a single plug-in pin on said mounting ring or on said light source carrier and extending approximately parallel to a middle axis of said mounting ring, and a corresponding plug-in fitting on said light source carrier or said mounting ring, said plug-in pin and plug-in fitting forming a mounting which secures against a pivotal movement, by means of which said light source carrier is connected exclusively with said mounting ring, and said plug-in fitting and said plug-in pin having a cross-sectional form which extends in an elongate manner in the circumferential direction.

2. A recessable luminaire according to claim 1, wherein said mounting ring is formed with a tube support which is coaxial with regard to said middle axis, and a flange part projecting outwardly therefrom, and said plug-in fitting or said plug-in pin being realized on said tube support.

3. A recessable luminaire according to claim 1 or 2, wherein said plug-in recess and said plug-in pin have a non-round cross-sectional form.

4. A recessable luminaire according to claim 1, and further including a positioning device which is effective in the plugged together condition, said positioning device being formed by said plug-in recess and said plug-in pin.

5. A recessable luminaire according to claim 1, wherein said coupling pin is conically formed towards a free end thereof and wherein said plug-in recess is correspondingly conically formed.

6. A recessable luminaire according to claim 5, wherein said plug-in recess and said plug-in pin releasably jam on one another in their plugged-together condition.

7. A recessable luminaire according to claim 1, wherein said plug-in pin is arranged on said mounting ring and said plug-in fitting is arranged on the light source carrier.

8. A recessable luminaire according to claim 1, wherein said plug-in fitting is arranged on a projection standing up from said light source carrier.

9. A recessable luminaire according to claim 1, and further including an intermediate piece having at one end thereof a matching plug-in recess and at the other end thereof a matching plug-in pin.

* * * * *